US005454172A

United States Patent [19]

Crigger

[11] Patent Number: 5,454,172

[45] Date of Patent: Oct. 3, 1995

[54] SHOE WEAR PROTECTOR

[76] Inventor: William L. Crigger, 10 Cambridge, Manhattan Beach, Calif. 90266

[21] Appl. No.: 285,695

[22] Filed: Aug. 4, 1994

[51] Int. Cl.[6] ..... A43B 13/22

[52] U.S. Cl. ..... 36/72 R; 36/71.5; 36/73

[58] Field of Search ..... 36/72 R, 71.5, 36/73, 74, 132, 136, 96, 77 R

[56] References Cited

U.S. PATENT DOCUMENTS

| | | | |
|---|---|---|---|
| 1,094,016 | 4/1914 | Ramer | 36/72 R |
| 1,651,345 | 11/1927 | Frank | 36/72 R |
| 2,040,001 | 5/1936 | Jones | 36/71.5 |
| 2,710,463 | 6/1955 | Liska | 36/71.5 |
| 2,747,303 | 5/1956 | Abrahams | 36/72 R |
| 3,028,689 | 4/1962 | Dassler | 36/72 R |
| 3,497,972 | 3/1970 | Lyman | 36/72 R |
| 4,166,328 | 9/1979 | Hamilton | 36/72 R |
| 4,246,706 | 1/1981 | Persons, Jr. | 36/73 |
| 4,768,296 | 9/1988 | Gibbs | 36/72 |
| 4,825,563 | 5/1989 | Strongwater | 36/73 |
| 4,922,629 | 5/1990 | Bouchet | 36/36 |
| 5,257,469 | 11/1993 | Beasley | 36/72 |

FOREIGN PATENT DOCUMENTS

| | | | |
|---|---|---|---|
| 1947929 | 2/1930 | Australia | 36/73 |

*Primary Examiner*—Steven N. Meyers
*Attorney, Agent, or Firm*—Jack C. Munro

[57] ABSTRACT

A wear protector for a shoe in the form of a solid, flexible pad which is to be adhesively secured to a localized area on the upper of a shoe. The pad includes an exterior surface and is configured of a plurality of ridges and a plurality of grooves with there being a groove located between each directly adjacent pair of ridges. Each ridge is to encounter abrasive wear thereby protecting the upper of the shoe from wear in the area of the solid, flexible pad. During flexing of the shoe the material of the grooves deflects so as to not hinder the flexing movement of the shoe.

4 Claims, 1 Drawing Sheet

SHOE WEAR PROTECTOR

BACKGROUND OF THE INVENTION

1) Field of the Invention

This invention relates to the field of shoes and more particularly to a new antiwear protective element to be fastened to the upper of a shoe, particularly an everyday athletic type shoe used by children.

2) Description of the Prior Art

In the constructing of shoes the sole of the shoe is designed to take wear that is normally encountered during walking and running. The upper of the shoe, which surrounds the top of the foot and the ankle is generally made of fabric and is not designed to encounter significant wear. During certain activities, the upper of a shoe will encounter localized wear which will cause the upper to become frayed or produce a hole which results in premature failure of the shoe. Premature failure of shoes is common in conjunction with children since certain activities that children engage in do cause abrasive wear to a localized area of a shoe.

One such activity is riding skateboards. There are certain maneuvers in conjunction with a skateboard which applies a particular area of one shoe against the abrasive surface of the skateboard with a rubbing action occurring therebetween. This rubbing action quickly produces a hole in one shoe which requires premature replacement of the pair of shoes.

In order to avoid this premature replacement, skateboarders have been known to make fabric pads and tape or sew the same to their shoes in the area where the localized wear occurs. These fabric pads also quickly wear out requiring replacement.

SUMMARY OF THE INVENTION

The primary objection of the present invention is to construct a solid, flexible pad which is designed to be adhesively secured to a shoe in a localized area which will protect that shoe against localized excessive wear.

Another objective of the present invention is to construct a solid, flexible pad which is made of abrasive resistant material such as urethane plastic and is able to be used for an extended period of time before requiring replacement and frequently will last as long as normal wear of the shoe.

Another objective of the present invention is to construct a solid, flexible pad which can be manufactured at a relatively inexpensive cost and therefore sold to the ultimate consumer at a relatively inexpensive price.

The wear protector for a shoe of the present invention comprises a solid, flexible pad which is shaped to conform to the majority of shoes that are used by children during skateboarding activity. The solid, flexible pad is designed to cover the area of a shoe that most often encounters the localized wear. The pad is constructed to include a series of ridges and grooves with there being a groove between each directly adjacent pair of ridges. The material within each groove is thin and flexible so as to deflect during normal flexing of the shoe. The shape of each of the grooves is radial relative to a center point. This center point is spaced from the lower edge of the pad and is adapted to be in substantial alignment with the pivoting point of the foot that is placed within the shoe. This pivoting point is at the ball of the foot. During flexing of the shoe, which occurs during the pivoting of the foot, the thin material within the grooves deflect and overlap in order that the pad does not hinder normal flexing of the shoe.

DETAILED DESCRIPTION OF THE PREFERRED EMBODIMENT

Figure 1:
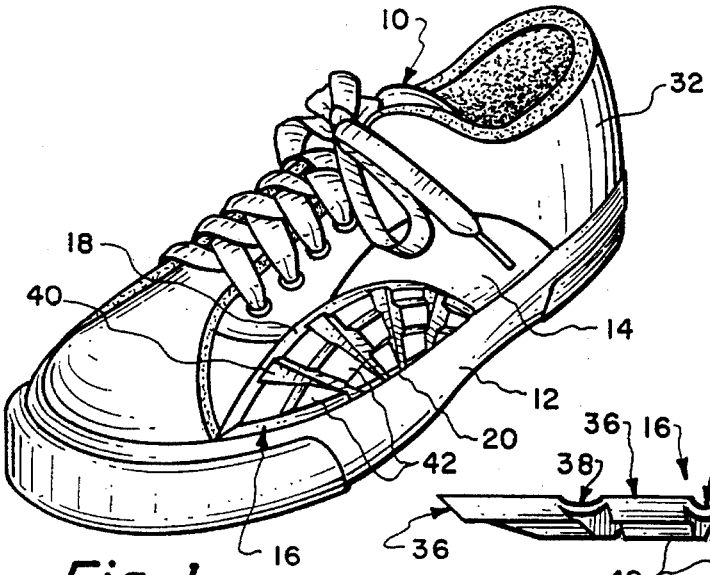
FIG. 1 is an isometric view of a typical shoe upon which has been mounted the solid, flexible pad of the present invention.
Figure 4:
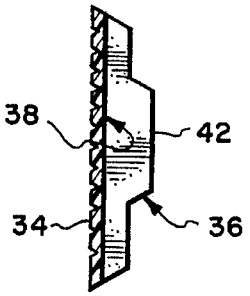
FIG. 4 is a cross-sectional view taken along line 4—4 of FIG. 3.

Referring particularly to the drawing there is shown a shoe 10 that has a sole 12 and an upper 14. Adhesively secured to a localized area of the upper 14 is the solid, flexible pad 16 of the present invention. This solid, flexible pad 16 has an upper edge 18 and a lower edge 20. The lower edge 20 is to be located directly against the sole 12. The normal area of wear on the upper 14 is in alignment with the ball 22 of the foot 24. The foot 24 has an arch 26 and toes 28. At the ball 22 is a pivot point which is in alignment with the center point 30. Normally it is the intention to install the pad 16 on the upper 14 so that the pad 16 is located directly adjacent the ball 22 of the foot 24.

The pad 16 is constructed of a plastic material with urethane being generally preferred. The pad 16 is readily flexible or bendable so as to comply with any and all confirmation of the upper 14 to which it is applied. For example, the pad 16 could be readily applied around the heel area 32 of the upper 14 if such application is deemed to be desired. It is to be understood that application of the pad 16 is to be accomplished by the user.

Figure 3:
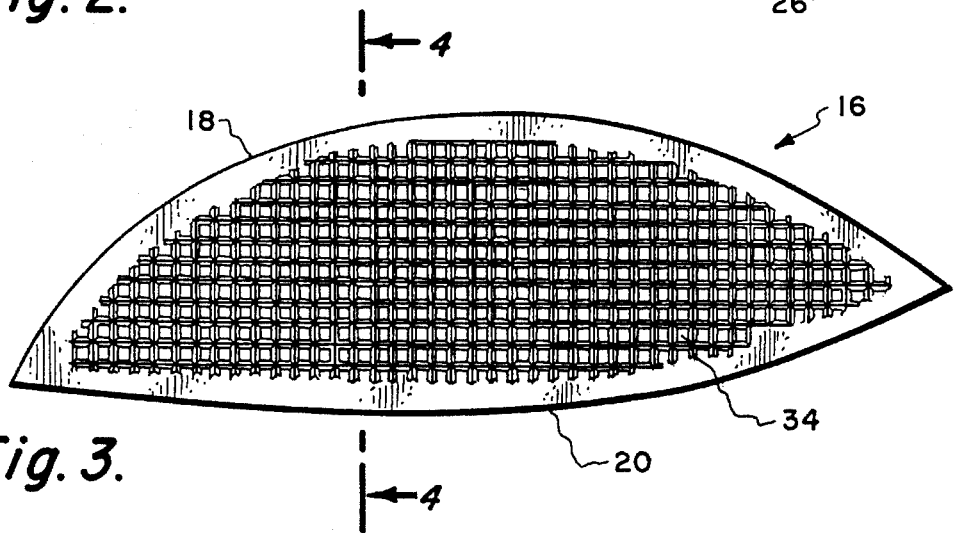
FIG. 3 is a back view of the solid, flexible pad of the present invention.

The back of the pad 16, which is shown in FIG. 3, is hiatused to form a roughened surface 34. A typical roughened surface would be a series of cross grooves forming a square type of pattern. This roughened surface 34 is to facilitate the securement of the adhesive (not shown) between the upper 14 and the pad 16.

The exterior surface of the pad 16 is formed of a plurality of ridges 36 and a plurality of grooves 38. There is to be a groove 38 located between each adjacent pair of ridges 36. The sidewalls of the grooves 38 all extend to intersect the center point 30. It is to be noted that the width of groove 38 directly adjacent the top edge 18 is of a greater width than the width of each groove 38 located directly adjacent the bottom edge 20. This automatically occurs when the sidewalls of the grooves 38 are oriented to intersect with the center point 30. It can thusly be said that the grooves 38 are radially disposed relative to the center point 30.

Figure 5:
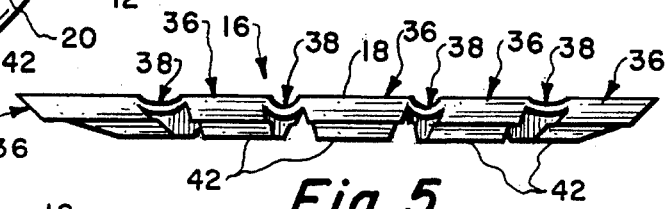
FIG. 5 is an edge view of the pad which comprises the wear protector of the present invention showing the position of the pad during flexing movement of the shoe on which it is mounted.
Figure 2:
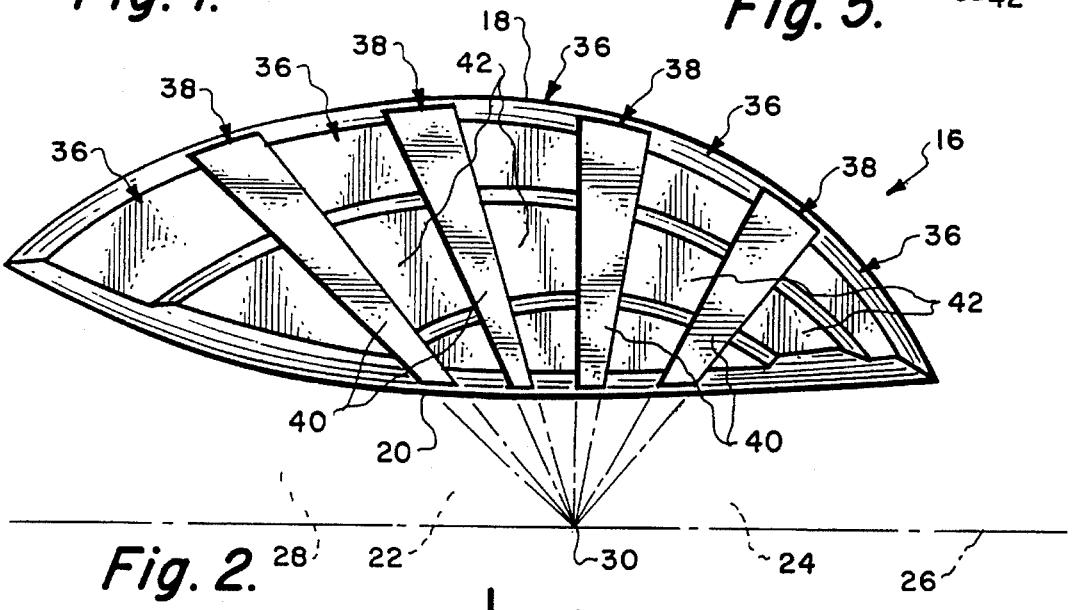
FIG. 2 is a front view of the solid, flexible pad of the present invention showing its relationship in conjunction with a foot that would be contained within the shoe.

Each of the grooves 38 includes a base in the form of a thin strip of material 40. This thin strip of material is readily bendable as is clearly shown in FIG. 5. This bending is to naturally occur when the shoe 10 flexes when the user runs, jumps, or moves forward to stand on the toes 28 of the foot 24. It is the purpose of these thin strips of material 40 to not hinder the normal flexing movement of the shoe 10.

It is the intention of the ridges 36 to directly encounter the abrasive action that normally would be subjected to the upper 14 of the shoe 10. It has been found to be best to construct each of the ridges 36 to include a raised protuberance 42. These raised protuberances 42 may be worn to the level of the lower in height portion of each of the ridges 36 and then those ridges 36 will actually be worn to even a lower level. If the pad 16 becomes so worn that in some areas the ridges 36 are approaching the height level of the thin strips 40, then replacement of the pad 16 would be recommended.

What is claimed is:

1. In combination with a shoe, a wear protector, said shoe having a sole to which is secured an upper, said wear protector comprising:

a solid, flexible pad having a top edge and a bottom edge with said solid, flexible pad having a front and a back, said back to be adhesively secured to said upper with said bottom edge located directly adjacent said sole, said solid, flexible pad covering only a small percentage of the total area of said upper, said front having a plurality of ridges and a plurality of grooves, each said groove located between each directly adjacent pair of said ridges, each said ridge has a raised protuberance, each said groove including a thin strip of material, each said thin strip of material being readily deflectable, whereby during flexing of said shoe said thin strips of material are to deflect thereby not hindering flexing of said shoe, whereby said ridges are to encounter abrasive contact with an outside structure thereby protecting said upper from excessive localized wear.

2. In combination with a shoe, a wear protector, said shoe having a sole to which is secured an upper, said wear protector comprising:

a solid, flexible pad having a top edge and a bottom edge with said solid, flexible pad having a front and a back, said back to be adhesively secured to said upper with said bottom edge located directly adjacent said sole, said solid, flexible pad covering only a small percentage of the total area of said upper, said front having a plurality of ridges and a plurality of grooves, each said groove located between each directly adjacent pair of said ridges, each said groove including a thin strip of material, each said thin strip of material being readily deflectable, whereby during flexing of said shoe said thin strips of material are to deflect thereby not hindering flexing of said shoe, whereby said ridges are to encounter abrasive contact with an outside structure thereby protecting said upper from excessive localized wear; and each said groove being radially oriented relative to a center point which is spaced a short distance from said bottom edge, whereby said center point is to be substantially alignable with the ball of the foot located within said shoe which substantially coincides with the pivot axis of the foot during flexing of said shoe.

3. The combination as defined in claim 2 wherein:

each said thin strip being of greater width at said top edge than at said bottom edge.

4. The combination as defined in claim 3 wherein: each said ridge has a raised protuberance.

* * * * *